US006098293A

United States Patent [19]

Bronner

[11] Patent Number: 6,098,293

[45] Date of Patent: Aug. 8, 2000

[54] CAN OPENER WITH ROTATING BOTTOM SUPPORT

[75] Inventor: Michael P. Bronner, Sparta, Wis.

[73] Assignees: James H. Bronner; Thelma M. Bronner, both of Tomah, Wis.

[21] Appl. No.: 09/121,326

[22] Filed: Jul. 23, 1998

[51] Int. Cl.[7] ..... B67B 7/46

[52] U.S. Cl. ..... 30/405; 30/410; 30/419; 30/427; 30/434

[58] Field of Search ..... 30/401, 405, 419, 30/426, 434, 410, 427

[56] References Cited

U.S. PATENT DOCUMENTS

| | | | |
|---|---|---|---|
| 767,131 | 8/1904 | Agobian | 30/434 |
| 1,262,994 | 4/1918 | Stokes et al. | 30/434 X |
| 1,522,319 | 1/1925 | Nolan | 30/434 |
| 2,011,170 | 8/1935 | Ames | 30/401 |
| 2,441,322 | 5/1948 | Jager | 30/405 |
| 2,560,983 | 7/1951 | Policastro | 30/401 |
| 2,579,189 | 12/1951 | Jenson | 30/419 X |
| 2,711,580 | 6/1955 | Conway | 30/434 |
| 2,963,629 | 12/1960 | Rhodes | 30/410 X |
| 3,012,320 | 12/1961 | Embrey | 30/405 X |
| 3,060,567 | 10/1962 | Boyett | 30/405 |
| 3,898,898 | 8/1975 | Peres | 30/434 X |
| 4,028,805 | 6/1977 | Figlia | 30/405 X |

*Primary Examiner*—Kenneth E. Peterson

[57] ABSTRACT

A can opener is provided including a housing and an elevator mounted on the housing. Next provided is a blade assembly having a rotating blade. The blade assembly is coupled to the elevator for being moved downwardly upon a can such that the blade engages a lid of the can for removal purposes.

2 Claims, 1 Drawing Sheet

CAN OPENER WITH ROTATING BOTTOM SUPPORT

BACKGROUND OF THE INVENTION

1.Field of the Invention

The present invention relates to can openers and more particularly pertains to a new can opener with rotating bottom support for automatically removing a lid from a can.

2.Description of the Prior Art

The use of can openers is known in the prior art. More specifically, can openers heretofore devised and utilized are known to consist basically of familiar, expected and obvious structural configurations, notwithstanding the myriad of designs encompassed by the crowded prior art which have been developed for the fulfillment of countless objectives and requirements.

Known prior art can openers include U.S. Pat. Nos. 4,922,617; 5,347,720; 4,995,164; 4,561,182; 4,334,182; and U.S. Pat. No. Des. 317,552.

In these respects, the can opener with rotating bottom support according to the present invention substantially departs from the conventional concepts and designs of the prior art, and in so doing provides an apparatus primarily developed for the purpose of automatically removing a lid from a can.

SUMMARY OF THE INVENTION

In view of the foregoing disadvantages inherent in the known types of can openers now present in the prior art, the present invention provides a new can opener with rotating bottom support construction wherein the same can be utilized for automatically removing a lid from a can.

The general purpose of the present invention, which will be described subsequently in greater detail, is to provide a new can opener with rotating bottom support apparatus and method which has many of the advantages of the can openers mentioned heretofore and many novel features that result in a new can opener with rotating bottom support which is not anticipated, rendered obvious, suggested, or even implied by any of the prior art can openers, either alone or in any combination thereof.

To attain this, the present invention generally comprises a housing having an inboard extent with a rectangular configuration. As shown in FIG. 1, the inboard extent of the housing is defined by a rear face, a top face, a bottom face and a pair side faces which form a front rectangular opening with a front peripheral edge. The housing is further equipped with an outboard extent with semicircular top and bottom faces integrally coupled to the top and bottom faces of the inboard extent in coplanar relationship therewith. A semicylindrical front wall is mounted to a top portion of the front peripheral edge of the inboard extent and the periphery of the top face of the outboard extent to define hood. Rotatably mounted on the bottom faces of the inboard extent and outboard extent of the housing is a circular rotator plate. The rotator plate is equipped with a first motor situated therebeneath for rotating the rotator plate during the actuation thereof. Next provided is a ball screw rotatably mounted within the housing between the top and bottom face of the inboard extent of the housing. The ball screw is preferably situated adjacent to the rear face of the housing with a second motor for rotating the same. In use, the second motor rotates the ball screw in a first direction during the actuation thereof in a first mode and rotates the same in a second direction during the actuation thereof in a second mode. As best shown in FIG. 2, a blade assembly includes a post fixedly mounted within the housing between the top and bottom face of the inboard extent of the housing and in front of the ball screw. A casing of the blade assembly is slidably mounted on the post with a plurality of threaded grooves formed in a rear face thereof. These threaded grooves are in engagement with the ball screw for sliding downwardly and upwardly upon the rotation thereof in the first and second directions, respectively. A disk-shaped blade is rotatably mounted to the casing of the blade assembly with a third motor situated within the housing for rotating the blade during the actuation thereof. With reference still to FIG. 2, a magnet is shown to be mounted on the casing of the blade assembly. Finally, control circuitry is provided including a first sensor for automatically actuating the second motor in the first mode upon the placement of a can on the rotator plate. Associated therewith is a second sensor for automatically deactuating the second motor and actuating the first motor and the third motor for a predetermined amount of time upon the blade assembly engaging a top of the can and the magnet being attached to a lid of the can. The control circuitry is further adapted to deactivate the first motor and the third motor after the predetermined amount of time at which point the second motor is actuated in the second mode.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new can opener with rotating bottom support apparatus and method which has many of the advantages of the can openers mentioned heretofore and many novel features that result in a new can opener with rotating bottom support which is not anticipated, rendered obvious, suggested, or even implied by any of the prior art can openers, either alone or in any combination thereof.

It is another object of the present invention to provide a new can opener with rotating bottom support which may be easily and efficiently manufactured and marketed.

It is a further object of the present invention to provide a new can opener with rotating bottom support which is of a durable and reliable construction.

An even further object of the present invention is to provide a new can opener with rotating bottom support which is susceptible of a low cost of manufacture with regard to both materials and labor, and which accordingly is then susceptible of low prices of sale to the consuming public, thereby making such can opener with rotating bottom support economically available to the buying public.

Still yet another object of the present invention is to provide a new can opener with rotating bottom support which provides in the apparatuses and methods of the prior art some of the advantages thereof, while simultaneously overcoming some of the disadvantages normally associated therewith.

Still another object of the present invention is to provide a new can opener with rotating bottom support for automatically removing a lid from a can.

Even still another object of the present invention is to provide a new can opener with rotating bottom support that includes a housing and an elevator mounted on the housing. Next provided is a blade assembly having a rotating blade. The blade assembly is coupled to the elevator for being moved downwardly upon a can such that the blade engages a lid of the can for removal purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
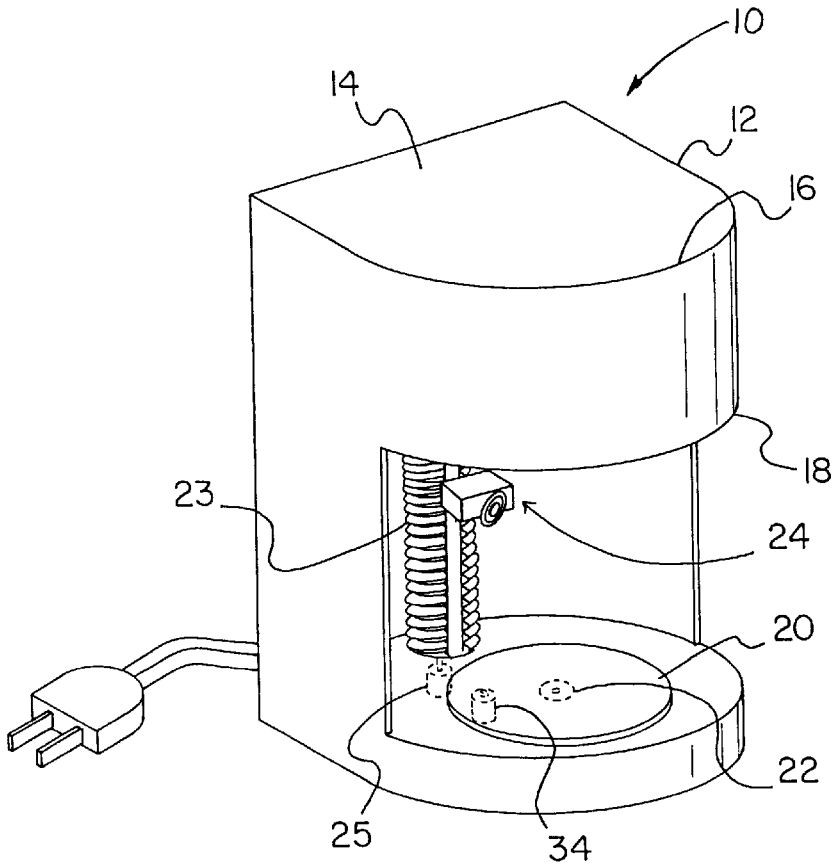
FIG. 1 is a perspective view of a new can opener with rotating bottom support according to the present invention.
Figure 2:
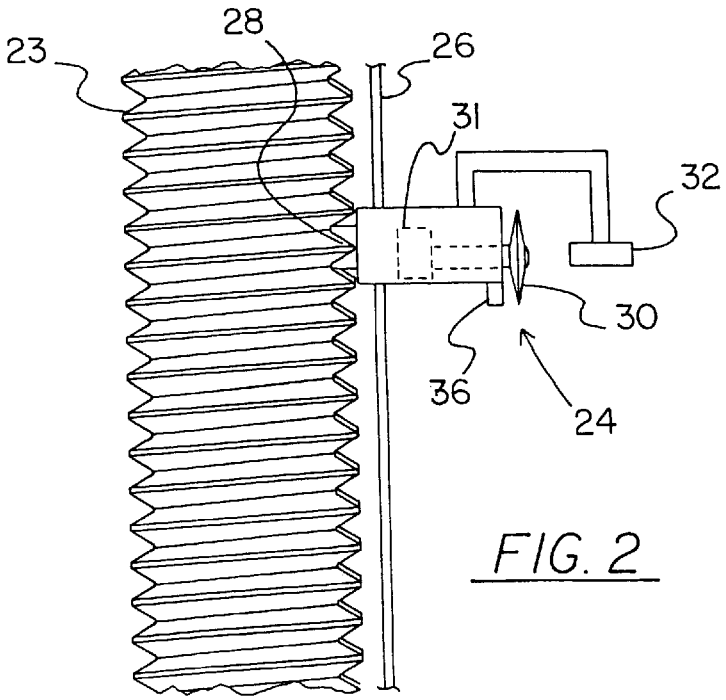
FIG. 2 is a detailed view of the ball screw and blade assembly of the present invention.

With reference now to the drawings, and in particular to FIGS. 1 through 2 thereof, a new can opener with rotating bottom support embodying the principles and concepts of the present invention and generally designated by the reference numeral 10 will be described.

The present invention, designated as numeral 10, includes a housing 12 having an inboard extent 14 with a rectangular configuration. As shown in FIG. 1, the inboard extent of the housing is defined by a rear face, a top face, a bottom face and a pair a side faces which form a front rectangular opening with a front peripheral edge. The housing is further equipped with an outboard extent 16 with semicircular top and bottom faces integrally coupled to the top and bottom faces of the inboard extent in coplanar relationship therewith. A semi-cylindrical front wall is mounted to a top portion of the front peripheral edge of the inboard extent and the periphery of the top face of the outboard extent to define hood 18.

Rotatably mounted on the bottom faces of the inboard extent and outboard extent of the housing is a circular rotator plate 20. The rotator plate is equipped with a first motor 22 situated therebeneath for rotating the rotator plate during the actuation thereof.

Next provided is a ball screw 23 rotatably mounted within the housing between the top and bottom face of the inboard extent of the housing. The ball screw is preferably situated adjacent to the rear face of the housing with a second motor 25 for rotating the same. In use, the second motor rotates the ball screw in a first direction during the actuation thereof in a first mode and rotates the same in a second direction during the actuation thereof in a second mode.

As shown in FIG. 2, a blade assembly 24 includes a vertical post 26 fixedly mounted within the housing between the top and bottom face of the inboard extent and in front of the ball screw. A casing of the blade assembly is slidably mounted on the post with a plurality of threaded grooves 28 formed in a rear face thereof. These threaded grooves are in engagement with the ball screw for sliding downwardly and upwardly upon the rotation of the ball screw in the first and second directions, respectively. A disk-shaped blade 30 is rotatably mounted to the casing of the blade assembly with a third motor 31 situated within the housing for rotating the blade when actuated. With reference still to FIG. 2, a magnet 32 is shown to be mounted on the casing of the blade assembly.

Finally, control circuitry is provided including a first sensor 34 for automatically actuating the second motor in the first mode upon the placement of a can on the rotator plate. It should be readily apparent that the first sensor may consist of a weight sensor positioned below the rotator plate, an electric eye, or any other type sensor capable of detecting the presence of the can. Associated therewith is a second sensor 36 for automatically deactuating the second motor and actuating the first motor and the third motor for a predetermined amount of time upon the blade assembly engaging a top of the can and the magnet being attached to a lid of the can. The predetermined amount of time is preferably long enough to allow one full revolution of the rotator plate. It should be readily apparent that the second sensor may include a push button mounted on a bottom face of the casing of the blade assembly, current load detecting circuitry associated with the second motor, or any other type of sensor capable of detecting when the blade assembly engages the can.

The control circuitry is further adapted to deactivate the first motor and the third motor after the predetermined amount of time at which point the second motor is actuated in the second mode. It should be noted that a limit switch or the like may be employed to ensure that the second motor deactuates when the blade assembly reaches the top of the ball screw. Given the straightforward nature of the operation of the control circuitry, it should be clear that any type of state table-governed logic circuitry, program driven processor or the like may be employed to accomplish the function which has been clearly set forth hereinabove. As an option, the motors may be manually activated and deactivated with a keypad.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A can opener comprising, in combination:

a housing including an inboard extent with a rectangular configuration defined by a rear face, a top face, a bottom face and a pair of side faces defining a front rectangular opening with a front peripheral edge, the housing further including an outboard extent with semi-circular top and bottom faces integrally coupled to the top and bottom faces of the inboard extent in coplanar relationship therewith and a semi-cylindrical front wall mounted to a top portion of the front peripheral edge of the inboard extent and the periphery of the top face of the outboard extent and extending downwardly therefrom to define a hood;

a circular rotator plate rotatably mounted on the bottom faces of the inboard extent and outboard extent of the housing with a plate motor situated therebeneath for rotating the rotator plate during the actuation thereof;

a ball screw rotatably mounted within the housing between the top and bottom face of the inboard extent of the housing adjacent to the rear face thereof with a ball screw motor for rotating the same in a first direction during the actuation thereof in a first mode and rotating the same in a second direction during the actuation thereof in a second mode;

a blade assembly including a post fixedly mounted within the housing between the top and bottom face of the inboard extent of the housing in front of the ball screw, a housing slidably mounted on the post with a plurality of threaded grooves formed in a rear face thereof which are in engagement with the ball screw for sliding downwardly and upwardly upon the rotation thereof in the first and second directions, respectively, a disk-shaped blade rotatably mounted to the casing of the blade assembly with a blade motor situated within the housing for rotating the blade during the actuation thereof;

a magnet mounted on the casing of the blade assembly; and control circuitry including a first sensor for automatically actuating the ball screw motor in the first mode upon the placement of a can on the rotator plate, a second sensor for automatically deactuating the ball screw motor and actuating the plate motor and the blade motor for a predetermined amount of time upon the blade assembly engaging a top of the can and the magnet being attached to a lid of the can, wherein the plate motor and the blade motor are deactuated after the predetermined amount of time and the ball screw motor is actuated in the second mode.

2. A can opener comprising:

a housing including an inboard extent with a rear wall, a top wall, a bottom wall and a pair of side walls, the inboard extent having a front opening with a front peripheral edge, the housing further including an outboard extent with top and bottom walls coupled to the top and bottom walls of the inboard extent in coplanar relationship therewith, and a front wall mounted to a top portion of the front peripheral edge of the inboard extent and the periphery of the top wall of the outboard extent, the front wall extending downwardly therefrom to define a hood;

a rotator plate rotatably mounted on the bottom walls of the inboard extent and outboard extent of the housing with a plate motor situated therebeneath for rotating the rotator plate during the actuation thereof;

a ball screw rotatably mounted in the housing between the top and bottom walls of the inboard extent of the housing and adjacent to the rear wall thereof, a ball screw motor for rotating the ball screw in a first direction during the actuation thereof in a first mode and rotating the ball screw in a second direction during the actuation thereof in a second mode;

a blade assembly including a post fixedly mounted in the housing between the top and bottom walls of the inboard extent of the housing in front of the ball screw, a housing slidably mounted on the post with a plurality of threaded grooves formed in a rear face thereof, the threaded grooves being in engagement with the ball screw for sliding downwardly and upwardly upon the rotation of the ball screw in the first and second directions, respectively, a disk-shaped blade rotatably mounted to a casing of the blade assembly with a blade motor situated in the housing for rotating the blade during the actuation of the blade motor;

a magnet mounted on the casing of the blade assembly; and control circuitry including a first sensor for automatically actuating the ball screw motor in the first mode upon the placement of a can on the rotator plate, a second sensor for automatically deactuating the ball screw motor and actuating the plate motor and the blade motor for a predetermined amount of time upon the blade assembly engaging a top of the can and the magnet being attached to a lid of the can, wherein the plate motor and the blade motor are deactuated after the predetermined amount of time and the ball screw motor is actuated in the second mode.

* * * * *